US006382444B1

(12) United States Patent
Nyman

(10) Patent No.: US 6,382,444 B1
(45) Date of Patent: May 7, 2002

(54) TAMPER-EVIDENT PLASTIC CLOSURE SYSTEM WITH SNAP-ON BAND

(75) Inventor: Henry Nyman, York, PA (US)

(73) Assignee: Sentinel Packaging Systems, Inc., York, PA (US)

( * ) Notice: Subject to any disclaimer, the term of this patent is extended or adjusted under 35 U.S.C. 154(b) by 0 days.

(21) Appl. No.: 09/527,205

(22) Filed: Mar. 16, 2000

Related U.S. Application Data

(60) Provisional application No. 60/124,835, filed on Mar. 17, 1999.

(51) Int. Cl.[7] ..... B65D 55/02

(52) U.S. Cl. ..... 215/252; 215/44; 215/334; 215/301; 215/218

(58) Field of Search ..... 215/44, 252, 253, 215/250, 258, 330, 331, 334, 335, 216–220, 301

(56) References Cited

U.S. PATENT DOCUMENTS 3,677,431 A * 7/1972 Westfall ..... 215/335 X
3,795,337 A * 3/1974 Nozawa et al. ..... 215/219
3,795,338 A * 3/1974 Swartzbaugh et al. ..... 215/220
3,809,365 A * 5/1974 Loffler ..... 215/253
3,850,328 A * 11/1974 Guala ..... 215/252
3,853,236 A * 12/1974 Ostrowsky ..... 215/220 X
3,901,403 A * 8/1975 Menke ..... 215/258 X
3,968,894 A * 7/1976 Herrmann ..... 215/258 X
3,972,436 A * 8/1976 Grau ..... 215/220
4,165,813 A * 8/1979 Babiol ..... 215/252 X
4,289,248 A * 9/1981 Lynn ..... 215/331 X
4,330,067 A * 5/1982 Deussen ..... 215/258 X
4,562,931 A * 1/1986 Brach et al. ..... 215/220
4,562,933 A * 1/1986 Dennis ..... 215/219
4,598,833 A * 7/1986 Herr ..... 215/220
4,629,082 A * 12/1986 Badia Iniesta ..... 215/253 X
4,646,926 A * 3/1987 Agbay et al. ..... 215/250 X
4,669,620 A * 6/1987 Coifman ..... 215/220
4,673,095 A * 6/1987 Puresevic et al. ..... 215/220
4,679,696 A * 7/1987 Bonnenfant et al. ..... 215/252
4,724,972 A * 2/1988 Marcus ..... 215/250 X
4,770,308 A * 9/1988 Lynn ..... 215/330
4,775,064 A * 10/1988 Baster ..... 215/252 X
4,801,028 A * 1/1989 Puresevic et al. ..... 215/220
4,832,218 A * 5/1989 Gibilisco ..... 215/220
5,020,681 A * 6/1991 Kusz ..... 215/220
5,076,453 A * 12/1991 Odet ..... 215/252
5,103,991 A * 4/1992 Collins ..... 215/252 X
5,161,706 A * 11/1992 Weinstein ..... 215/220 X
5,280,842 A * 1/1994 Koo ..... 215/220
5,433,331 A * 7/1995 Morini ..... 215/252 X
5,445,466 A * 8/1995 Mukunoki ..... 215/330 X
5,465,858 A * 11/1995 Gargione ..... 215/253 X
5,582,308 A * 12/1996 Kishi et al. ..... 215/252
5,611,443 A * 3/1997 King ..... 215/252 X
5,740,932 A * 4/1998 Battegazzore ..... 215/252
5,813,553 A * 9/1998 Herr et al. ..... 215/252
6,006,932 A * 12/1999 Morini ..... 215/250 X
6,085,920 A * 7/2000 Moretti ..... 215/252 X

* cited by examiner

*Primary Examiner*—Stephen P. Garbe
*Assistant Examiner*—Robin A Hylton
(74) *Attorney, Agent, or Firm*—Eugene E. Renz, Jr.

(57) ABSTRACT

A tamper evident closure for containers having finish a with thread means and a radially outwardly circumferentially extending bead below the threads comprising, a cap portion of cup-like form having internal threads for cooperatively engaging the threads on a container to apply and remove the cap portion, a retainer ring depending from the lower edge of the skirt portion of the cap and connected thereto by a series of circumferentially spaced bridge connections, and a tamper evident band having means for rotatably mount on the retaining ring and rotatable thereto and including a series of spring fingers for engaging under the retainer bead on the container when the closure is fully seated.

27 Claims, 15 Drawing Sheets

TAMPER-EVIDENT PLASTIC CLOSURE SYSTEM WITH SNAP-ON BAND

This application claims the benefit of U.S. Provisional Application No. 60/124,835 filed Mar. 17, 1999.

FIELD OF THE INVENTION

The present invention generally relates to tamper evident closures for bottles and other containers. The importance of providing tamper evident features on many types of containers that provide substances for general consumption is well accepted by manufacturers and the public.

BACKGROUND OF THE INVENTION

Plastic tamper evident closures commonly in use permit a certain amount of cap rotation in the "off " direction before the system applies enough force on the frangible element to physically indicate such a rotation. It is commonly possible to unscrew the closure system enough to compromise the closure/container seal, before a physical indication of opening can be observed. When this situation occurs, product can be dispensed from the container, and/or substances can be added to the container without physical indication of tampering. Two-piece "push and turn" child resistant closures commonly in use are notoriously frustrating to many users. When this system is combined with tamper-evident features, user frustration is multiplied because the child resistant "outer" must be depressed and turned multiple times before the tamper indicating band separates the child resistant "inner". Additionally, the tamper evident features make cap rotation more difficult until band separation occurs. There is shown in FIGS. 1 and 2 a so-called tamper evident closure of the prior art type. As shown therein, the closure comprises a cap portion having a circumferentially extending side-wall with internal threads and a tamper evident band projecting from the lower edge of the cap portion and connected thereto by a series of circumferentially spaced fracturable bridge connections. The tamper evident band has a flexible return flange which in the fully seated position of the cap engages in an enlarged retention bead forming part of the container finish. It has been found that this closure is not truly tamper proof, in that a user for example, can insert an instrument such as a screwdriver under the return flange in the manner shown in FIG. 1. The cap can then be rotated in the direction to remove it from the container and when the return flange bypasses the retention bead on the bottle finish, the cap can be removed and replaced. This presents the problem and danger of tampering with the contents of the container without there being any visual means indicating the container was accessed.

Another prior art closure of this general type is shown in the Herr et al. U.S. Pat. No. 5,813,553, entitled SNAP BAND TAMPER EVIDENT. This closure as shown comprises a cap portion (100) having a circumferentially extending depending internally threaded skirt and a so-called "tamper evident band" (140) with two concentric portions, wherein the first portion engages the snap fit ring is and is removed from the rest of the band when the closure is rotated in a direction to remove it from the container neck. A plurality of frangible posts are provided connecting the first and second portions. This closure is also not truly tamper proof since it has been found that when the cap is torqued onto the container, the inter-engaging parts of the cap and tamper evident band are stressed to a point where the band can be displaced from the cap without fracturing the posts.

More specifically, in Kerr '533, the two elements are held together by a mechanical interlock between a retention bead internal to the cap ring and a frangible feature, "snap fit band", integral to the band assembly. The snap fit band is attached to the lower portion of the band by a series of connecting bridges. To summarize Kerr's approach, the cap is designed to have an internal bead that retains a tamper-evident band through a frangible ring integral to the tamper indicating band. When an assembled cap of this design is applied to a container, a series of tabs integral to the band lock under a retention bead on the container. As the assembled cap is unscrewed, the tabs prevent the band from moving upward on the container, causing a fracture of the connecting bridges integral to the band which then causes the band to separate from the closure. The closure and the band cannot be reassembled after the initial opening. An undesirable consequence of this design encourages unintentional or intentional separation of the cap and tamper-indicating band, without breaking the frangible connecting element. When a cap is threaded onto a bottle and a certain amount of torque is applied, the cap's threads have a tendency to ride-up on the threads of the container deforming and outwardly flair the base of the cap exactly where the tamper-indicating band retention bead has been placed. If excessive deformation and flair occur, the amount of engagement between the frangible element of the snap band and the closure retention ring is reduced. In extreme situations where high torque levels are applied combined with normal cap/band manufacturing tolerances, cap/band engagement can be reduced allowing the band assembly to fall out of the closure without breaking the connecting bridges. Or worse, that a person could intentionally increase the torque on the cap assembly to encourage cap/band disengagement and then manipulate the band to disengage it from the cap without breaking the frangible element. In either event, the tamper-indicating band could be reapplied to a container without providing the intended indication of initial opening.

SUMMARY OF THE INVENTION

In accordance with the present invention, a truly tamper-proof closure is provided which essentially comprises a cap portion having a circumferentially extending, depending internally threaded skirt, a ring-like break away ring member connected to the lower terminal edge of the cap by a series of fracturable bridges. The ring has a radially outwardly directed flange which defines an annular pocket between the lower terminal edge of the cap and flange and a tamper evident band having a portion seated in the pocket. A series of retention tabs engage under the bottle finish when the cap is fully seated on the container. By this arrangement, when the cap is tightened on the container, the skirt is actually deflected radially outwardly and creates a stronger bond between the band and the lower portion of the cap in the manner shown in FIGS. 10 and 11. Accordingly, the main distinction over the prior art and the one that contributes to making the closure of the present invention truly tamper proof is the configuration and arrangement of the break away ring member and tamper evident band and the location of the fracturable bridges connecting the break away ring member to the lower terminal edge of the cap.

Another feature of the present invention is the provision of the so-called "anti-back off arrangement". In accordance with this feature, the upper face of the break away flange is provided with a series of inclined ramps and the enlarged portion of the tamper evident band has a series of complementary ramps which overlie and confront the breakaway flange ramps. These inter-engaging ramps define cam means between the members so that when the cap portion is rotated in a direction to remove it from the container, the tamper evident band is prevented from rotating and the band and cap are displaced axially to fracture all of the bridge connections uniformly.

By this arrangement, when the cap and tamper evident band are rotated in a direction to apply it to the container finish, the ramps are nested and this rotation does not stress or cause fracture of the fracturable bridges. On the other hand, when the cap is rotated in a direction to remove it from the container, the ramps cam relative to one another and by this process, the bridges are fractured since the displacement produces vertical displacement of the tamper-evident band and cap, thereby providing a truly tamper-proof arrangement.

This contrasts with the prior art arrangements, where there is a certain amount of axial displacement of the cap portion relative to the band before the bridges start to fracture. This present the possibility of breaking the seal between the cap and container which in turn, permits ingress or egress of fluid product which is undesirable. With the anti-back off feature, when the user turns the cap in the direction to remove it, the inter-engaging ramps come into play to provide a visual indicia that someone has tampered with the closure.

BRIEF DESCRIPTION OF THE DRAWINGS

These and other objects of the present invention and various features and details of the operation and construction thereof are hereinafter more fully set forth with reference to the accompanying drawings.

DETAILED DESCRIPTION OF THE PREFERRED EMBODIMENT

Figure 1:
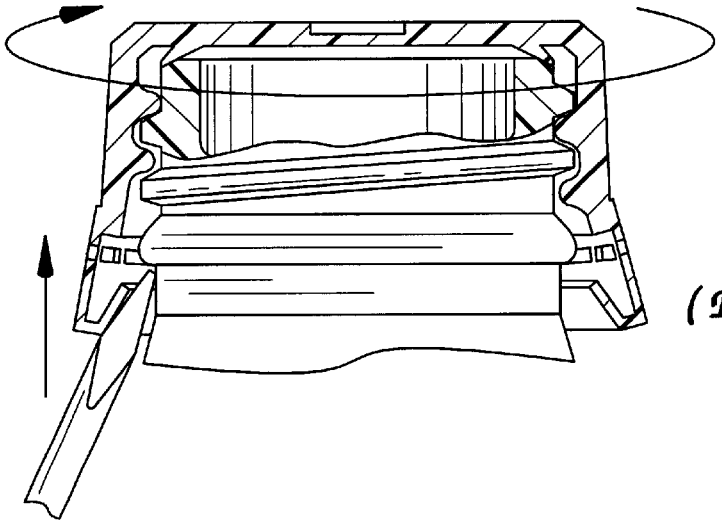
Fig 1 (Prior Art)
FIG. 1 is a cross-sectional front view of a standard tamper evident closure of the Prior Art showing an overly tightened cap with tampering by way of a screwdriver.

Referring now to the drawings and particularly to FIGS. 4–11 thereof, the closure which is generally designated by the numeral 10 is applied to a container (12) have the standard bottle finish including a spiral thread (14) at a radially outwardly directed circumferentially extending retention bead (16) spaced downwardly from the spiral threads (14). In the present instance, the container (12) has an enlarged circumferentially extending shoulder 18 and a outwardly tampered neck (20) below the shoulder.

Figure 5:
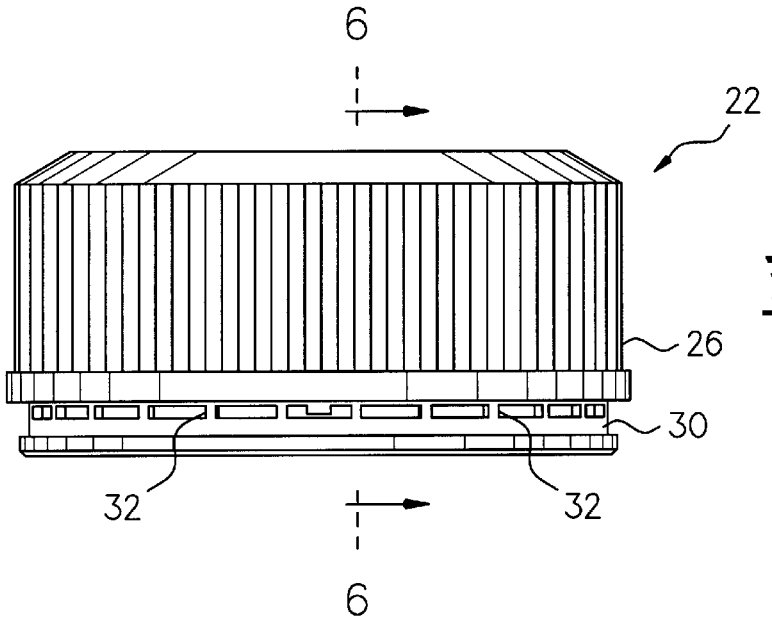
FIG. 5 is a front elevation of the cap of the present invention.
Figure 6:
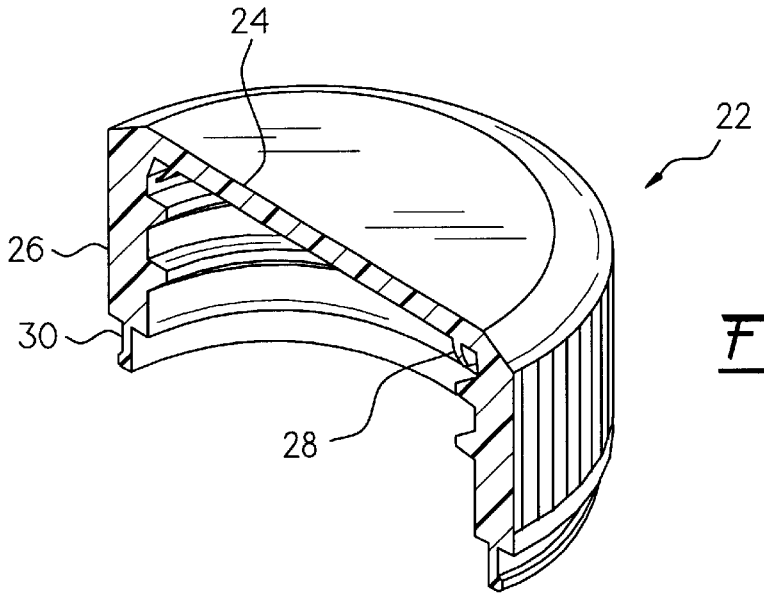
FIG. 6 is an isometric cross-section of the cap of the present invention taken along lines 6—6 of FIG. 5.
Figure 7:
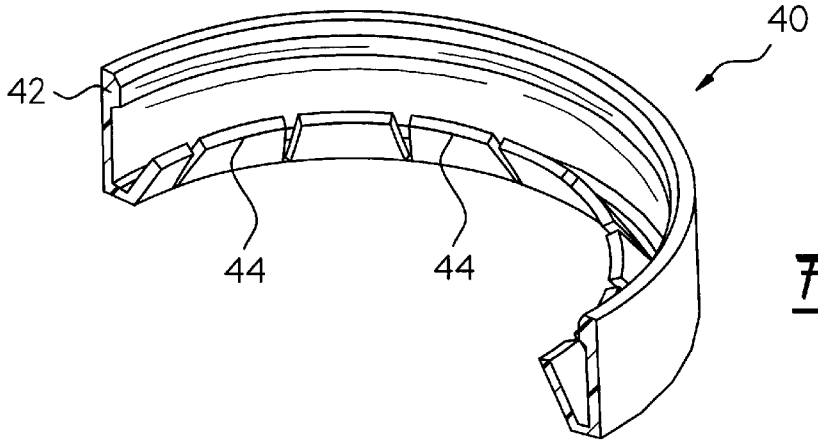
FIG. 7 is an isometric cross-section of the short tamper evident band.
Figure 8:
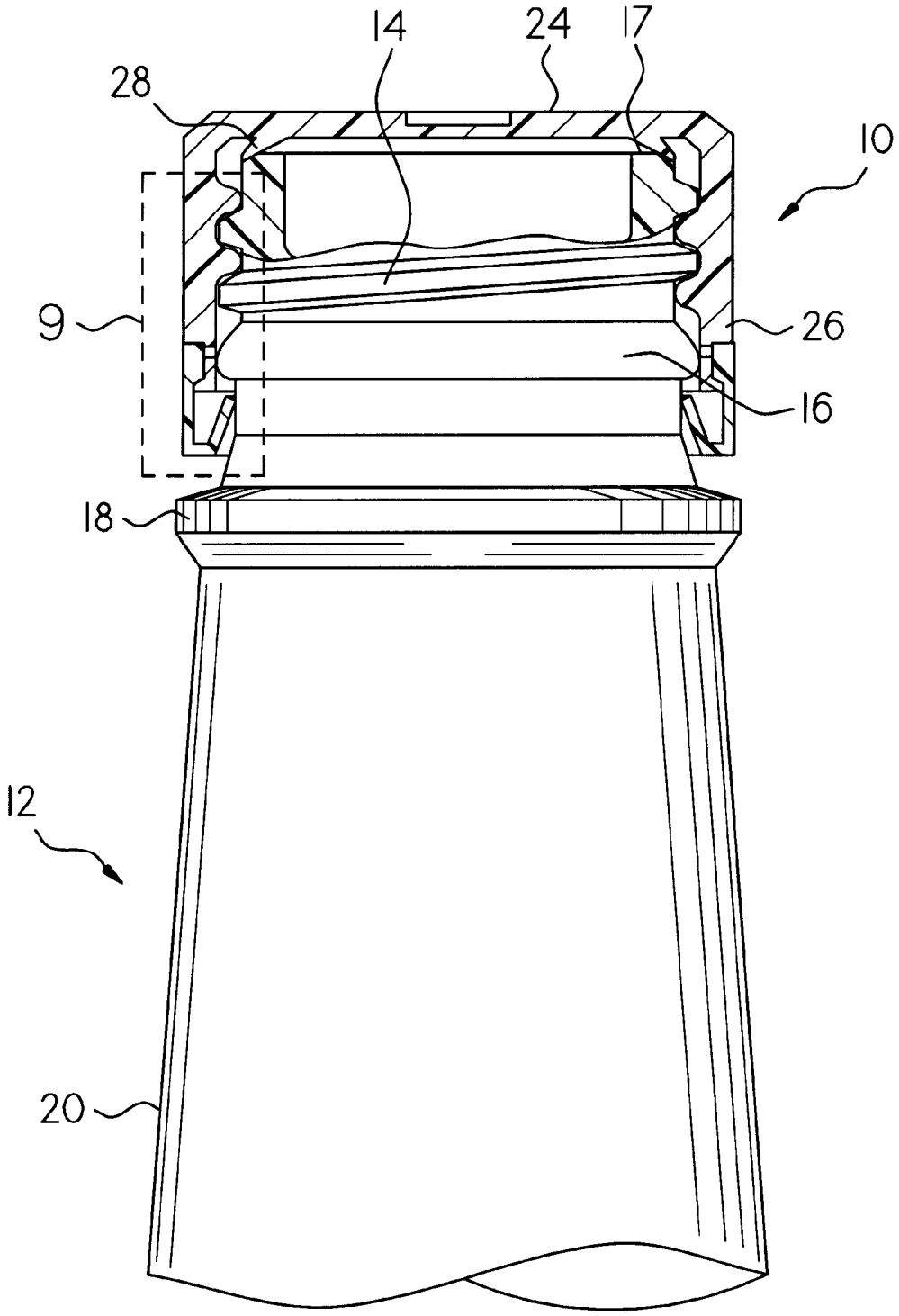
FIG. 8 is a partial cross-sectional front elevation of the tamper evident closure system with the short tamper evident band.
Figure 9:
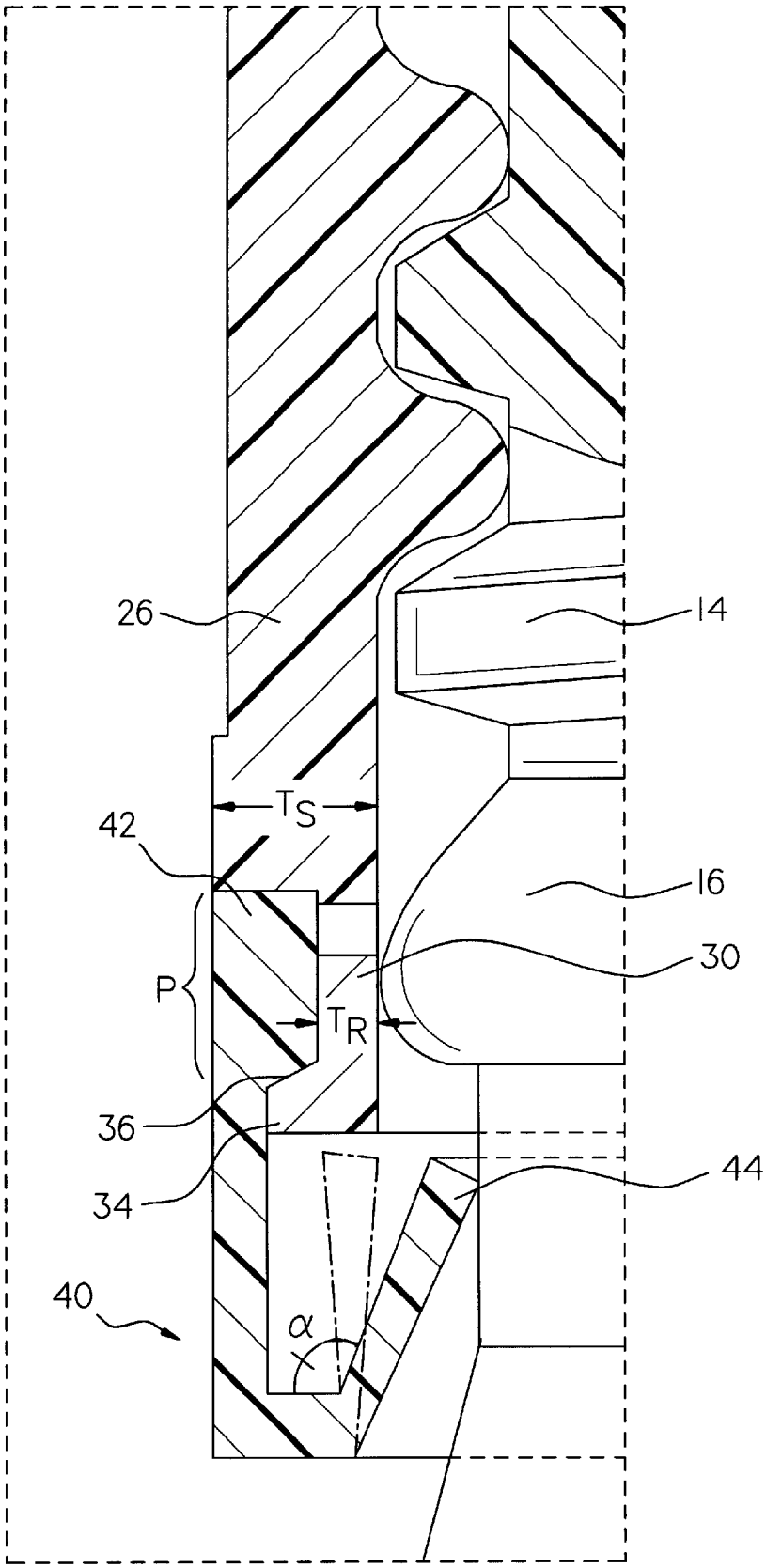
FIG. 9 is a fragmentary detail of the cap taken from dashed lines 9 of FIG. 8.
Figure 10:
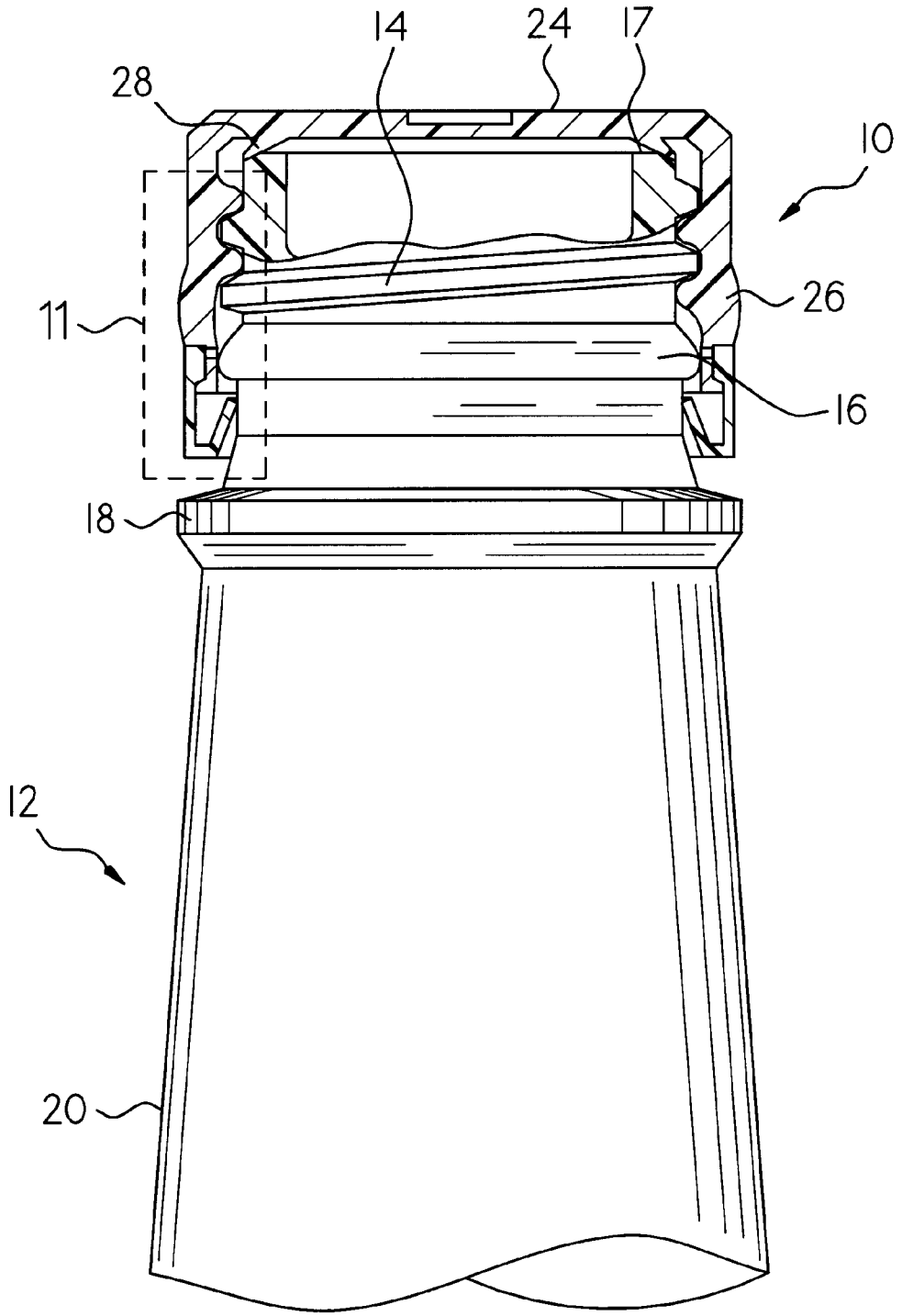
FIG. 10 is a partial cross-sectional front elevation with the short tamper evident band showing an overly tightened cap.
Figure 11:
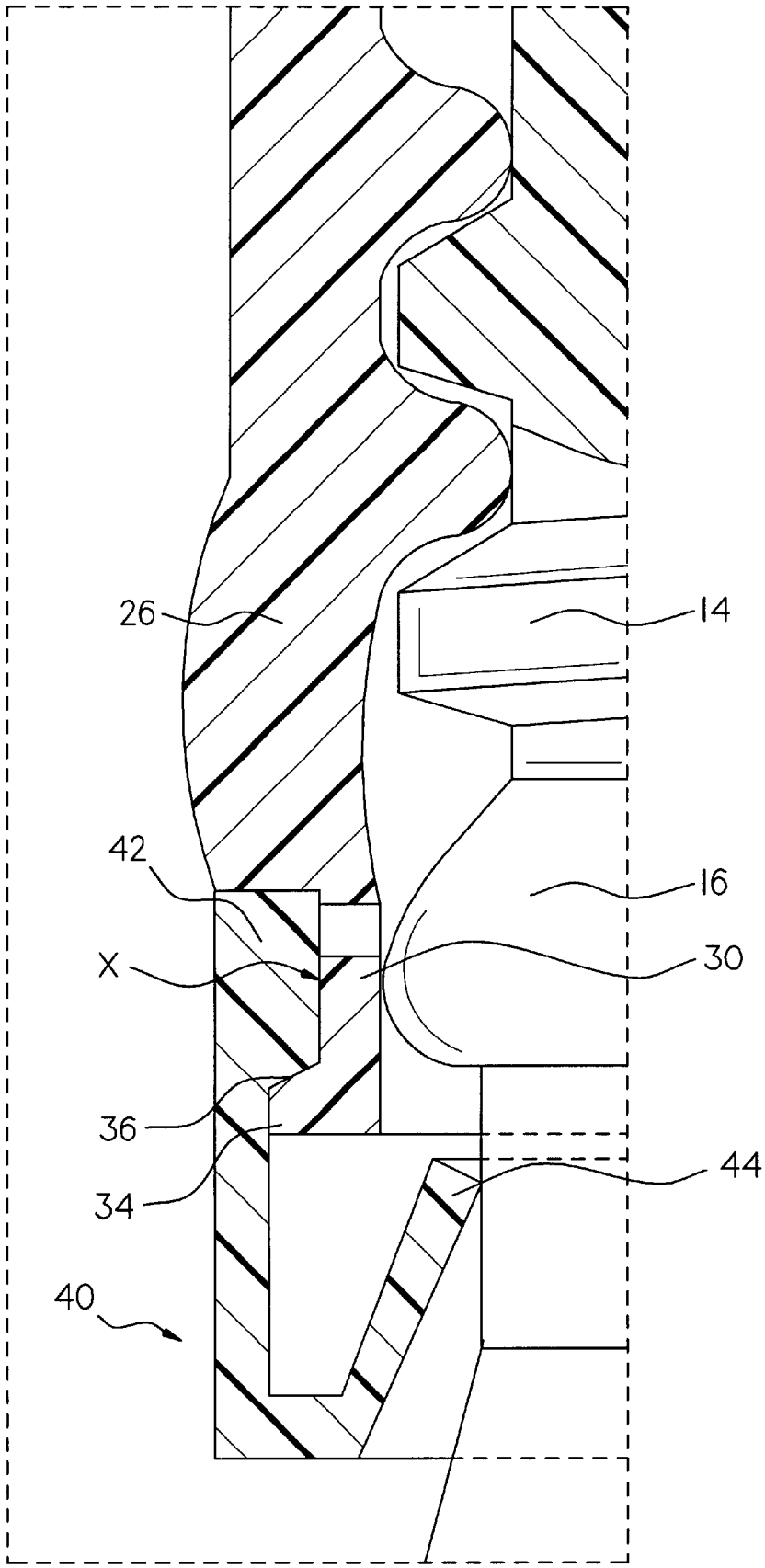
FIG. 11 is a fragmentary detail of the overly tightened cap taken from dashed lines 11 of FIG. 10.

The closure (10), as best illustrated in FIGS. 5, 6 and 8 may be made of a plastic material and comprises a cup-like cap portion (22) comprising a disc-like top (24) and a peripherally extending depending circumferential skirt (26). A seal (28) depends from the top and engages the axial end face (17) of the bottle finish to seal the contents of the container (12) when the closure (10) is fully seated in the manner shown in FIG. 8. The closure (10) further includes a break away ring (30) depending from the lower terminal edge of the skirt portion (26) connected to the lower edge by a series of circumferentially spaced fracturable bridges 32 [SEE FIG. 5]. The break away ring (30) is of a thickness $T_R$ which is less than the thickness ($T_S$) of the skirt (26) and has a radially outwardly directed flange (34) having an outwardly inclined frusto-conical upper face (36) confronting the lower face of the skirt portion (26) and defining a pocket P for the tamper evident band (40). The tamper evident band (40) as illustrated in FIG. 9 is aligned generally with the sidewall of the skirt (26) and has a enlarged head portion (42) in the form of a circumferentially extending, radially inwardly directed rib which nests in the pocket P in the manner shown in FIG. 9. The tamper evident band has a series of flexible fingers which normally are deposed at an inward obtuse angle α. The fingers (44) flex outwardly during application of the closure (10) to the container (12) to bypass the spiral threads and retention bead 16 and when the closure (10) is fully seated, they are disposed so that the tips of the fingers (44) underlie the retention bead on the container (12) in the manner shown in solid lines in FIG. 9.

Figure 2:
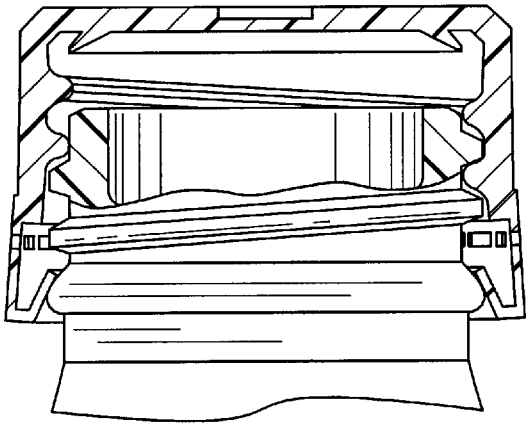
Fig 2 (Prior Art)
FIG. 2 is a cross-sectional front view of the standard tamper evident closure of FIG. 1 showing a defeated tamper evident cap and band.
Figure 3:
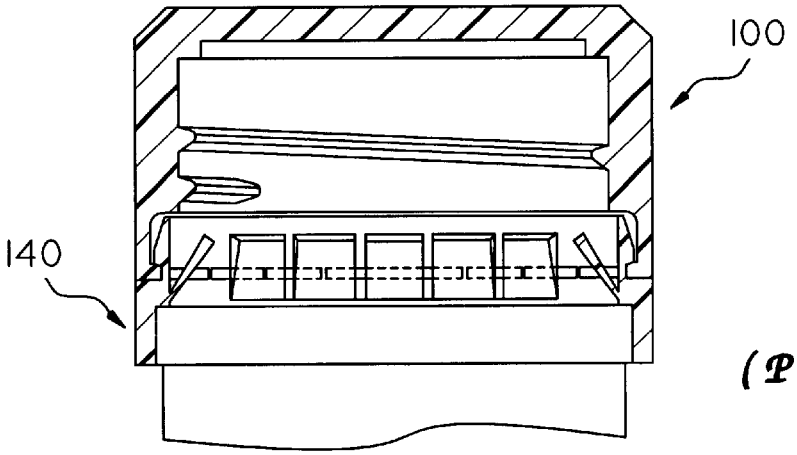
Fig 3 (Prior Art)
FIG. 3 is a cross-sectional front view of a tamper evident closure of the Prior Art.
Figure 4:
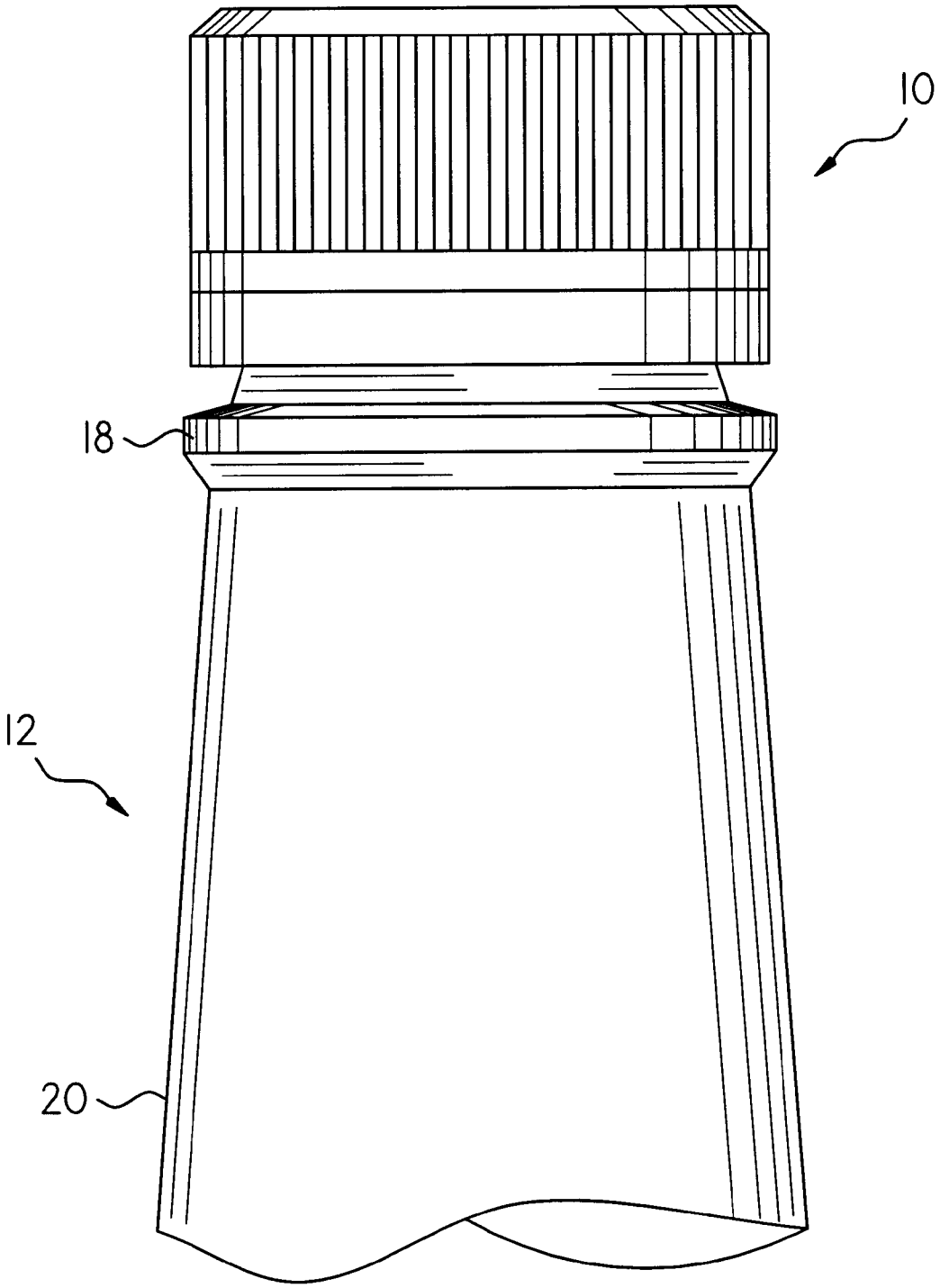
FIG. 4 is a front elevation of the tamper evident closure system with a short tamper evident band.

Considering now briefly, assembly and use of the closure system as described above. The cap portion end and the tamper evident band are preassembled to form a unitary closure (10) system and are then, as a unit, applied to a filled container (12) by automatic assembly equipment. The flexible fingers or tabs (44) flex inwardly to the position shown in broken lines in FIG. 9 during initial assembly to bypass the spiral thread (14) and the retention bead (16) until the cap is fully seated on the container (12) to the position shown in FIG. 8. In this position, the seal engages the axial end face (17) of the container (12) to seal the contents of the container. Now if a user turns the cap portion in a direction to tighten it more on the container (12), the skirt portion (26) will bow outwardly, thereby creating an even better seal at the critical juncture between the ring (30) and the tamper evident band in the region X shown in FIG. 11. This in effect creates an obstacle to prying the closure (10) assembly with an instrument or the like, as was typical in the prior arrangements shown in FIGS. 1–3, inclusive.

Figure 12:
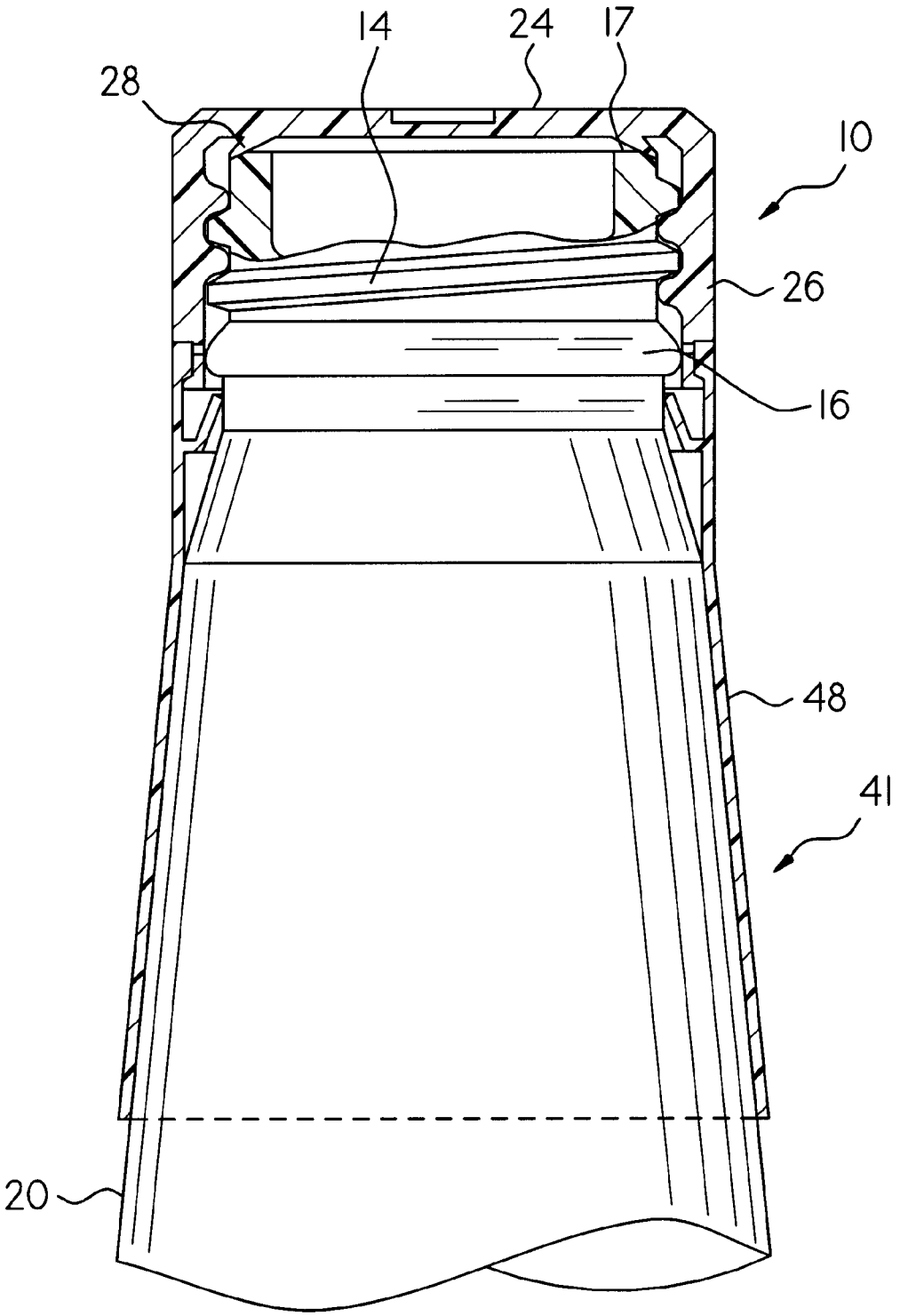
FIG. 12 is a partial cross-sectional front elevation with the long tamper evident band.
Figure 13:
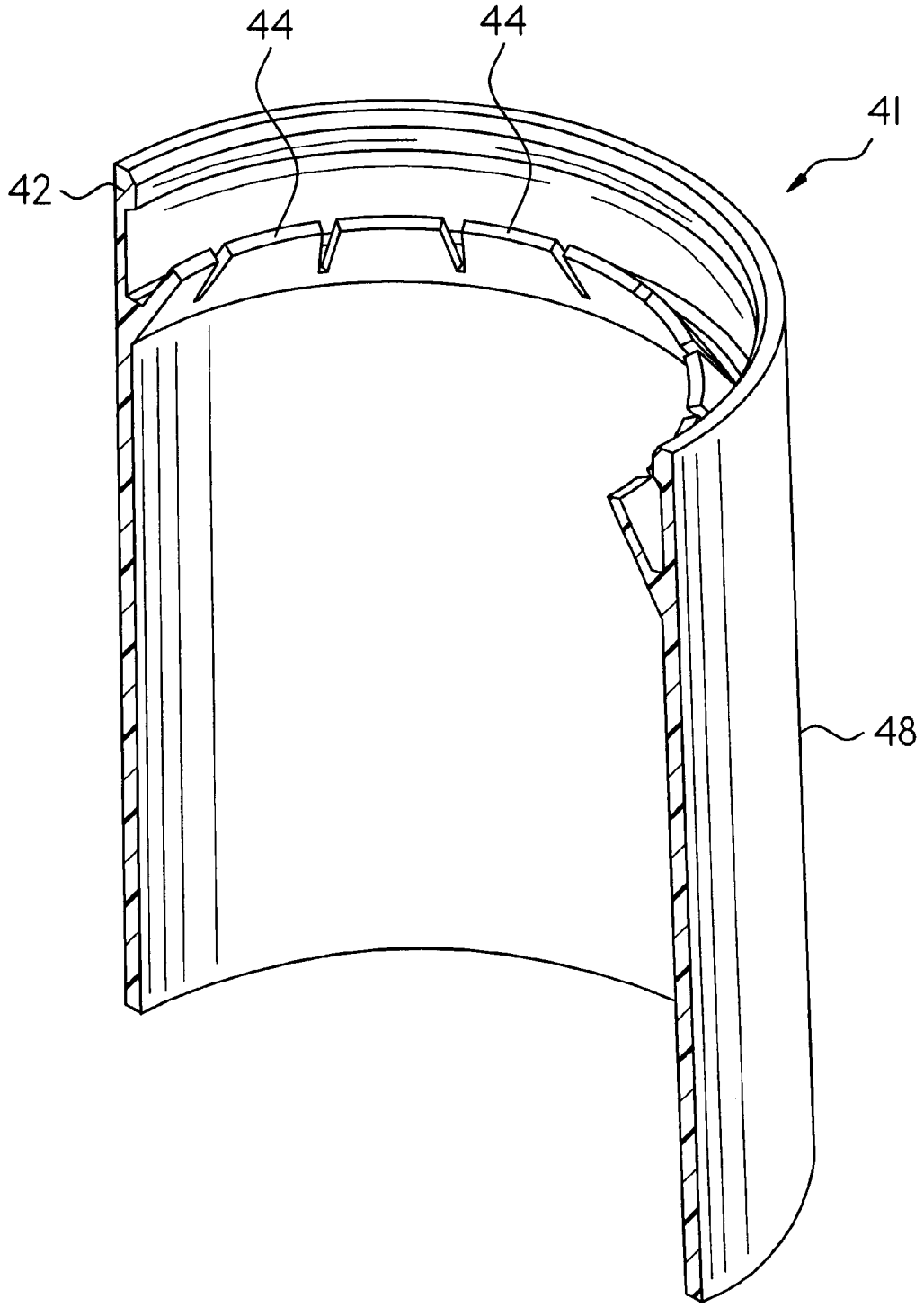
FIG. 13 is an isometric cross-section of the long tamper evident band.
Figure 14:
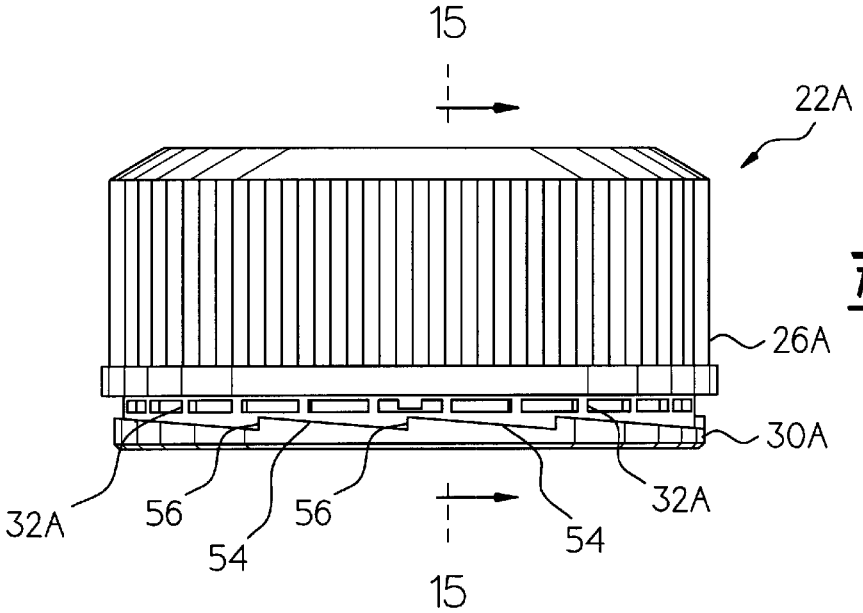
FIG. 14 is a front view of an alternate embodiment of a cap with ramps.
Figure 15:
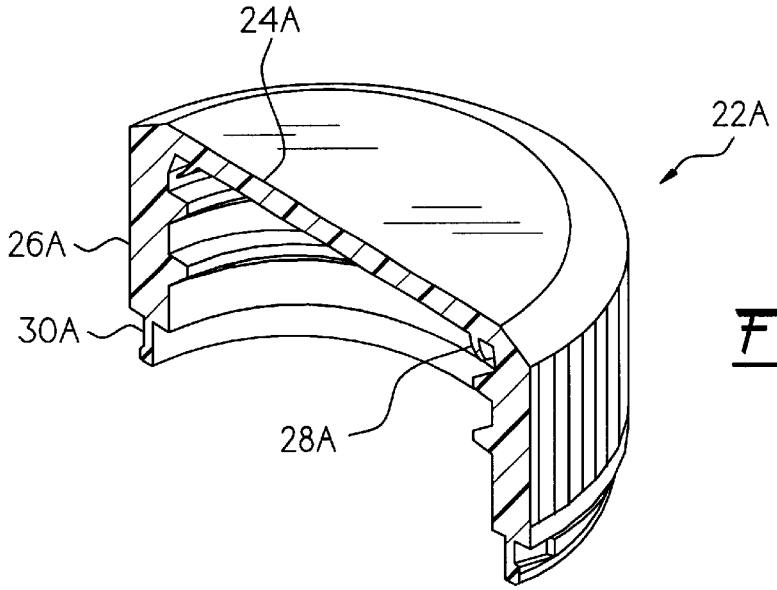
FIG. 15 is a cross-sectional isometric view of the cap with ramps taken along lines 15—15 of FIG. 14.
Figure 16:
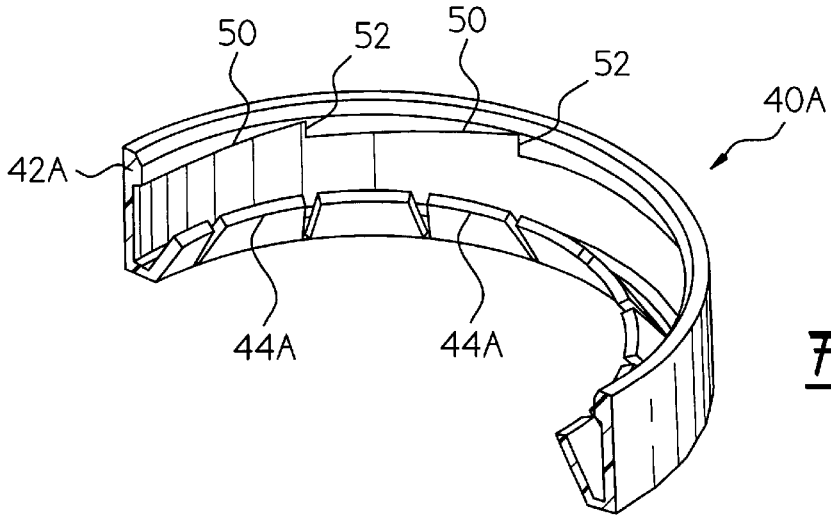
FIG. 16 is a cross-sectional isometric view of a short tamper evident band with ramps.

There is shown in FIGS. 12 and 13 a modified embodiment of tamper evident closure (10) system in accordance with the present invention. The closure (10) is generally similar to that described above, regarding the details and arrangements of the cap portion and tamper evident band. However, in this instance, the tamper evident band (41) has an elongated downwardly depending sleeve (48) which snugly embraces the tamper finish of the bottle in the manner shown in FIG. 12.

Figure 17:
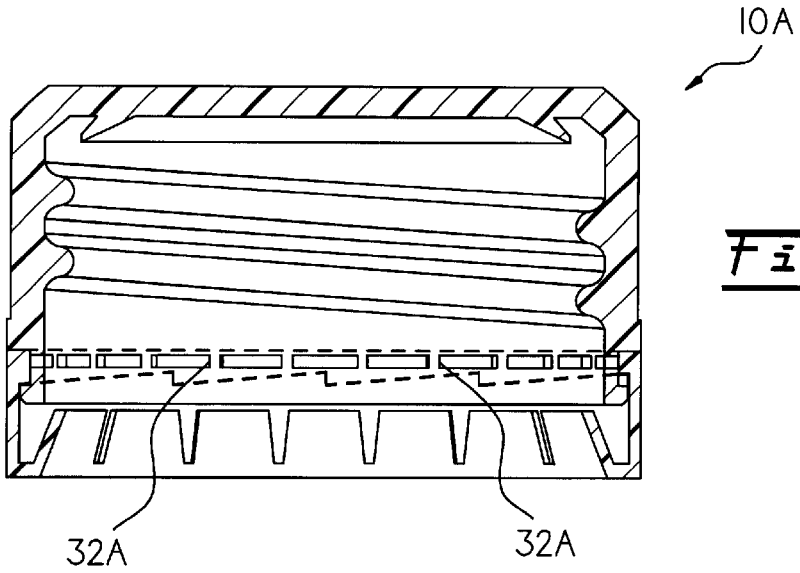
FIGS. 17–19 are sequential cross-sectional side views of the cap and short band with ramps of the present invention showing the fracturing of the frangible bridges.
Figure 18:
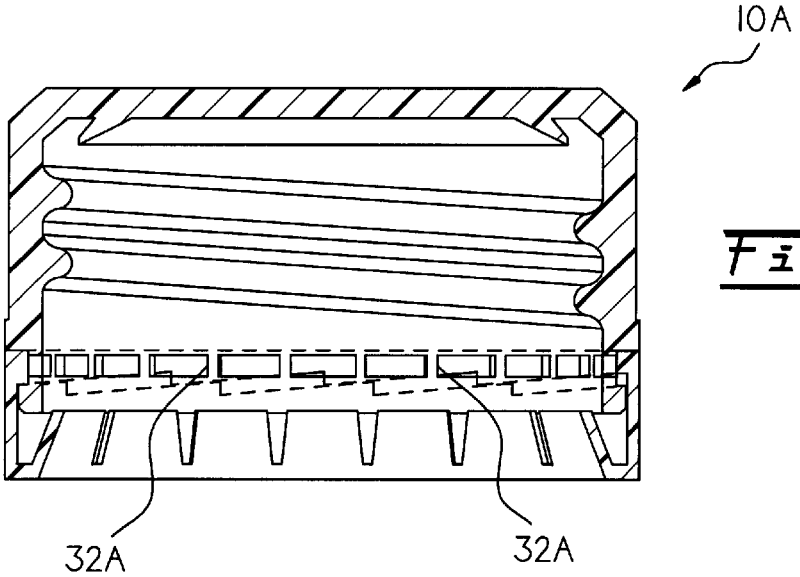
Figure 19:
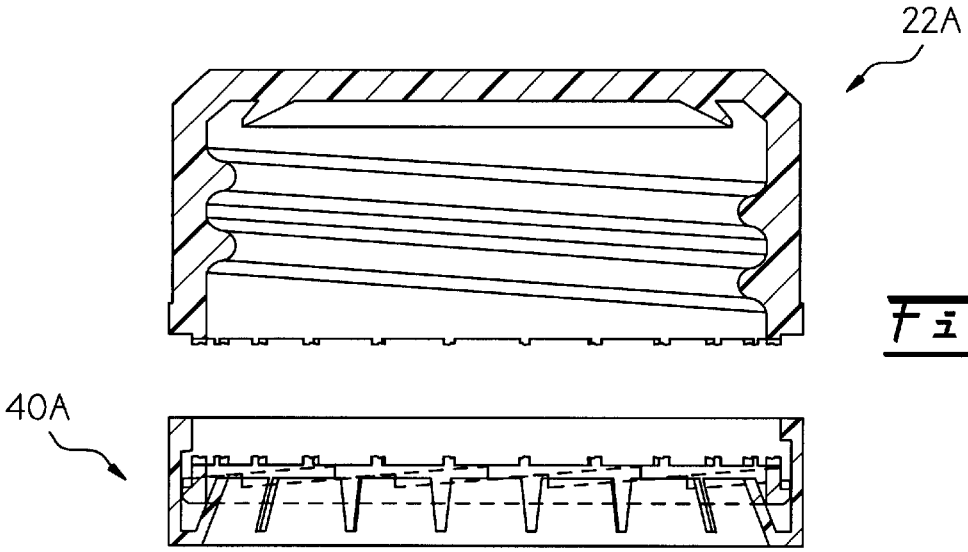
Figure 20:
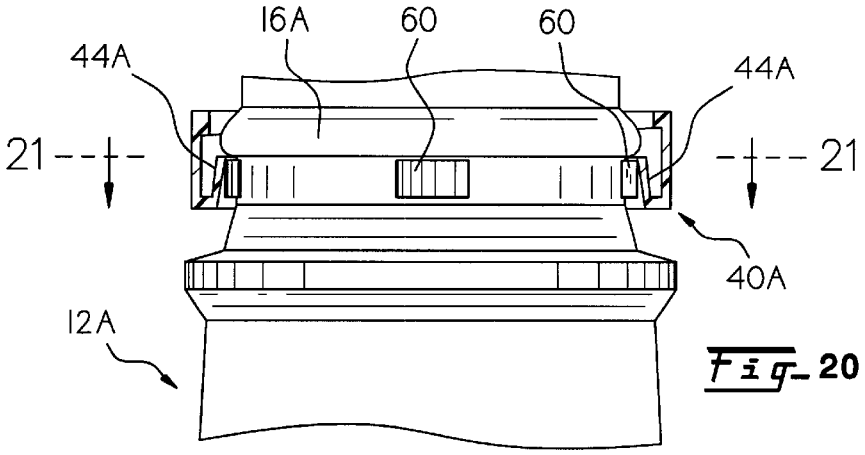
FIG. 20 is a partial cross-sectional side view of the short band and bottleneck showing cams on the bottleneck.

The elongated skirt (48) or tall band provides a large surface area for advertising and the like, such as the name of the product and other brand names. The tall band also adds another tamper resistant feature to the extent that the user cannot engage a paper clip or other instrument and turn the cap (22) where the instrument functions like a ratchet to prevent removable of the entire cap (22) without fracturing the bridges (32). There is shown in FIGS. 14–24, inclusive, another embodiment of tamper evident closure (10A) system in accordance with the present invention. The cap portion and the tamper evident band (40A) are in some respects similar or identical to the principal embodiment and accordingly, for those parts like reference numerals are used in the drawings with the subscript "A". Thus, the closure (10A) system comprises a cap portion generally designated by the numeral "22*a*" having a dependent skirt (26A), a break away ring (30A), and a tamper evident band (40A) which nests in the pocket of the break away band (30A) as shown in FIGS. 17 and 18.

However, in the present instance, instead of the tamper evident band (40A) having a continuous frusto-conical inner-face on the head portion, this face of the head portion is provided with a series of inclined ramps (50) separated by vertical shoulder (52). A series of inclined ramps (54) separated by shoulder (56) on the portion of the break away ring (30A) confronts the tamper evident band ramps (50) in the manner shown in FIGS. 17–19, inclusive.

Figure 21:
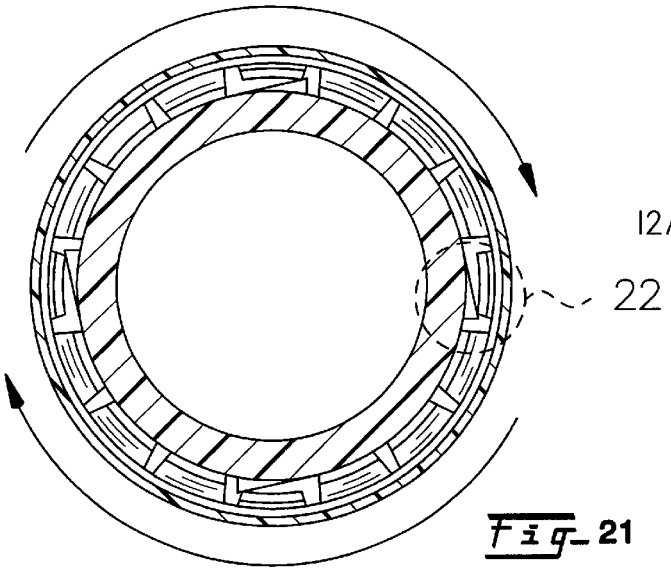
FIG. 21 is a cross-sectional top view of the band turning clockwise around the bottleneck where the band flanges ratchet over the bottle cams taken generally along line 21—21 of FIG. 20.
Figure 22:
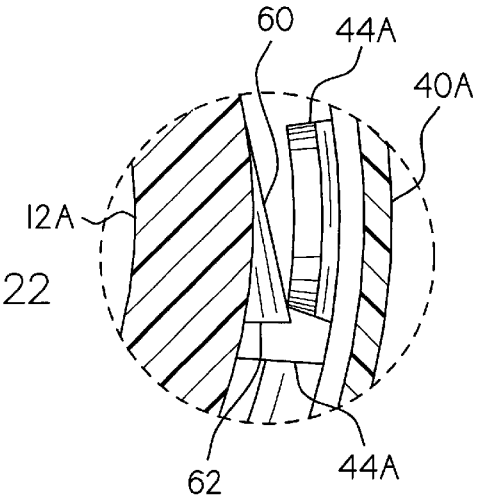
FIG. 22 is a fragmentary detail view of FIG. 21 taken from dashed lines 22 of FIG. 21.
Figure 23:
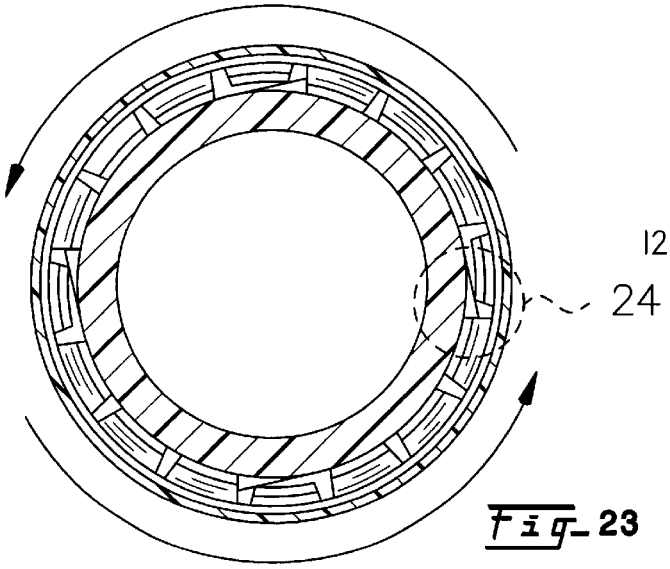
FIG. 23 is a cross-sectional top view of the band turning counter-clockwise around the bottleneck where the band flanges abut the bottle cams.
Figure 24:
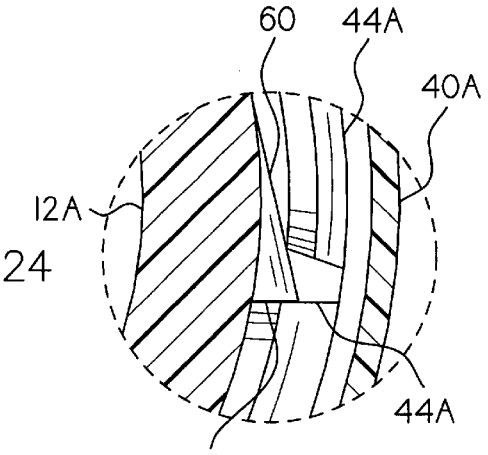
FIG. 24 is a fragmentary detail view of FIG. 23 taken from dashed lines 24 of FIG. 23.

The bottle finish in the region below the retainer bead (16A) has a series of circumferentially spaced vertical lugs or ramps (60) which are aligned with the flexible tabs or fingers (44A) of the tamper evident band (40A). When the closure (10A) is applied to the bottle (12A) and turned in a clockwise direction, the flexible tabs (44A) of the tamper evident band (40A) ratchets over the ramps (60) of the bottle (12A) as shown in FIGS. 21 and 22. When the closure (10) is turned in a counter-clockwise direction, the flexible tabs (44A) of the tamper evident band (40A) engage the shoulders (62) of the vertical lugs (60) on the bottle (12A) as shown in FIGS. 23 and 24.

Considering now use and operation of the closure (10A) system in accordance with the present invention, the closure (10A) is assembled to the container (12A) as an integral unit with the tamper evident band (40A) in much the same manner described previously. However, in accordance with this embodiment, the inter-engaging inclined ramps (54) on the break away ring (30A) and the tamper evident band (40A) provide a anti-back-off feature virtually eliminating the possibility for breaking the seal between the cap (22A) and the container (12A) when attempting to remove the closure (10A) without providing some visual indica thereof. For example, when the closure (10A) is turned in a counter-clockwise direction to remove it, as shown in FIG. 23, the closely spaced flexible fingers (44A) engage a shoulder portion of the ramp (62) with only a small degree of rotation to prevent further rotation. Thus, only a very small, insignificant rotation is allowed in the closure (10A) system which preserves not only tamper evidency, but desired sealing relationship. Now when it is desired to access the bottle, the user simply continues rotation of the cap (22A) in the counter-clockwise direction, shown in FIG. 23, whereby the inter-engagement of the fingers (44A) with the shoulders of the vertical lugs (60) prevents rotation of the tamper evident band (40A) to produce elongation of the connecting bridges as shown in FIG. 18 and eventual fracture of all of the bridges. It is noted that the inter-engaging inclined ramp arrangement facilitates quick and uniform release or breaking of the bridges simply by rotating the cap (22A) relative to the tamper evident band (40A). This produces not only good tamper evidency but ensures uniform breaking of the bridges around the entire circumference.

Figure 25:
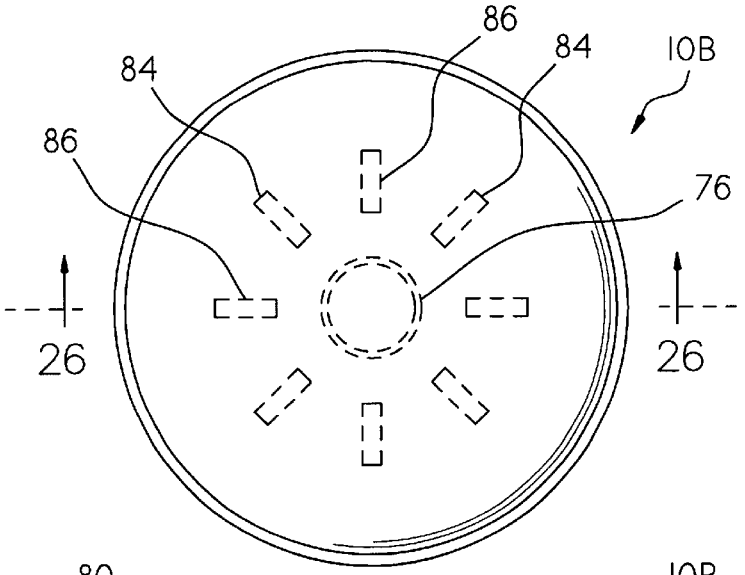
FIG. 25 is a top view of an alternate embodiment of a tamper evident closure system with a safety mechanism.
Figure 26:
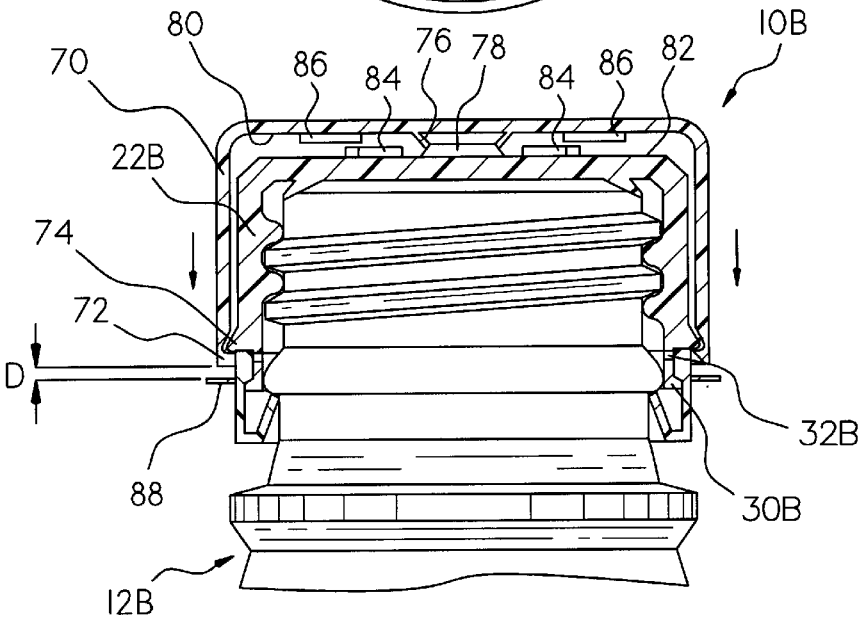
FIG. 26 is a cross-sectional side view of the alternate embodiment taken along lines 26—26 of FIG. 25 showing the safety mechanism in a non-engaged position and a tamper evident band in an intact state.
Figure 27:
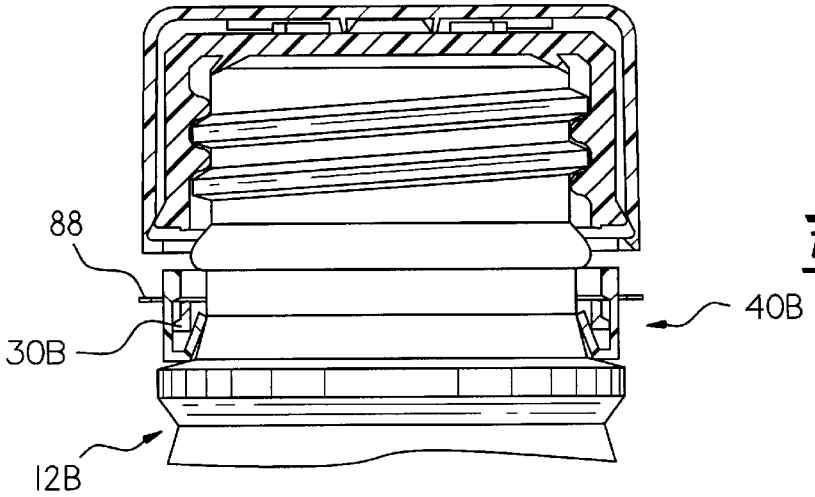
FIG. 27 is a cross-sectional side view similar to FIG. 26 showing the safety mechanism in an engaged position and the tamper evident band in a fractured state.

There is shown in FIGS. 25–27 inclusive a further modification of the present invention. The elements of the closure (10B) which are generally the same as that previously described such as the cap portion (22B) and retaining ring (16B) and tamper-evident band (40B) are given the same reference numerals as in the principle embodiment, except that they are designated with a subscript B.

In accordance with this embodiment, the closure (10B) is provided with an overcap (80) of cup-like form which snap fits over the cap portion (22B) of the closure (10B), and has a radially inwardly directed rib (72) at the lower end of the skirt (70) which engages under a complementary circumferentially extending retaining rib (74) on the cap portion (22B). The overcap is normally biased to a raised position by means of a living spring element (76) which projects from the inner face of the top of the cap (80) and engages a circular button (78) on the top of the cap portion (22B). The top surface (82) of the top of the cap portion (22B) and the inner face of the overcap have a series of radially extending circumferentially spaced ribs (86) and lugs (84) which, as illustrated in FIG. 25, are disposed in a circular array, and are normally spaced apart or displaced from one another axially in the manner shown in FIG. 26 by the living spring (76) to permit free rotation of the overcap (80) relative to the cap portion (22B). By this arrangement, the closure system is child tamper proofed. Now when it is desired to activate the closure (10B) system, the overcap is pressed axially downwardly against the normal bias of the living spring (76) whereby the ribs (86) and lugs (84) inter-engage. Now when the overcap is rotated in a direction to remove it from the container (12B), the overcap and cap portion (22B) move as an integral unit to fracture the bridge connections (32B) between the cap portion (22B) and ring (30B) in the manner described previously. In the present instance, the retaining band has a radially outwardly directed circumferentially extending flange (88) normally spaced from the lower edge of the overcap, a predetermined distance (D) so that when the overcap is pressed inwardly, it engages the flange (88) and displaces the tamper-evident band (40B) downwardly a sufficient controlled distance to fracture the bridge connections to thereby permit free removal of the cap portion (22B) from the container (12B). This provides a tamper-evident arrangement in that the tamper-evident band and portion of the retaining ring (30B) remain on the container (12B) in the manner shown in FIG. 27.

Figure 28:
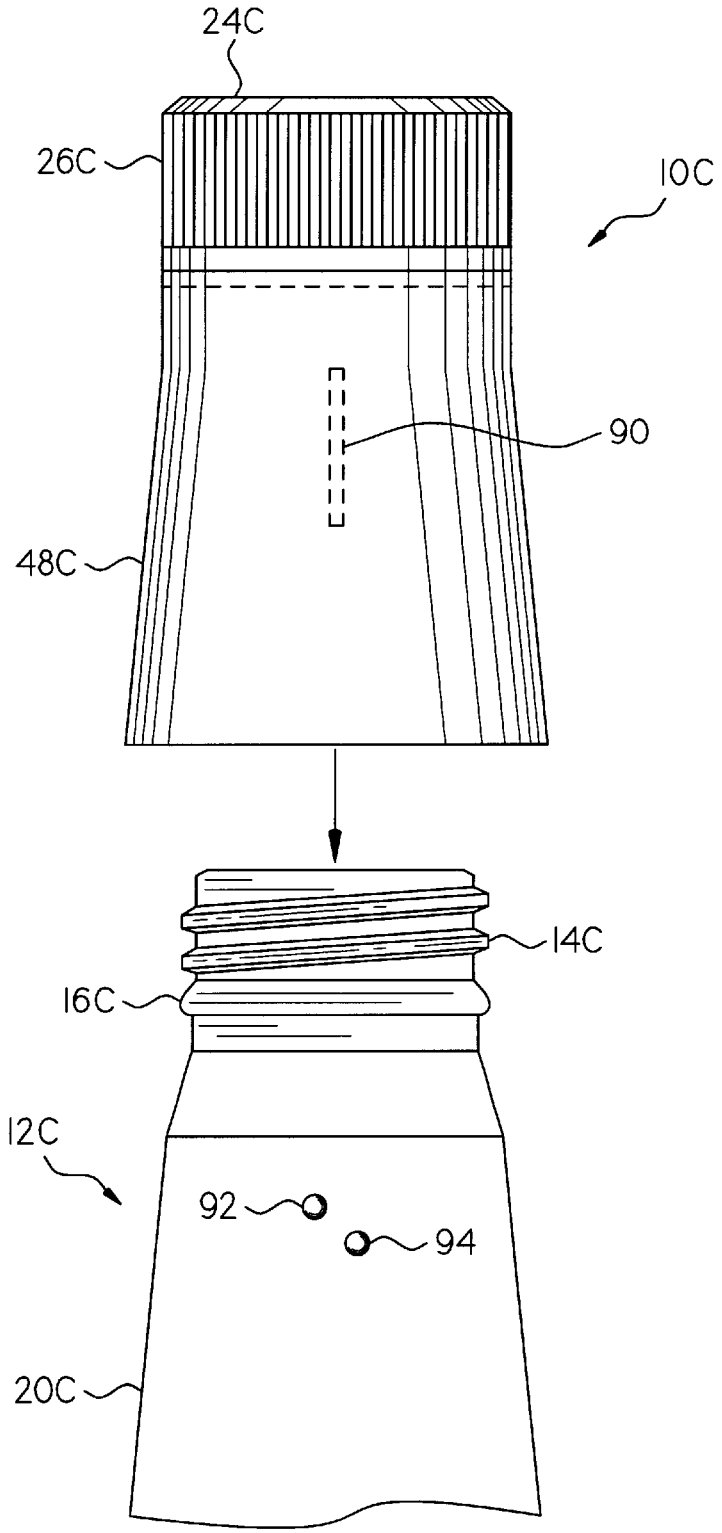
FIG. 28 is a side elevation of an alternate embodiment of a tamper evident closure system with a band alignment system.
Figure 29:
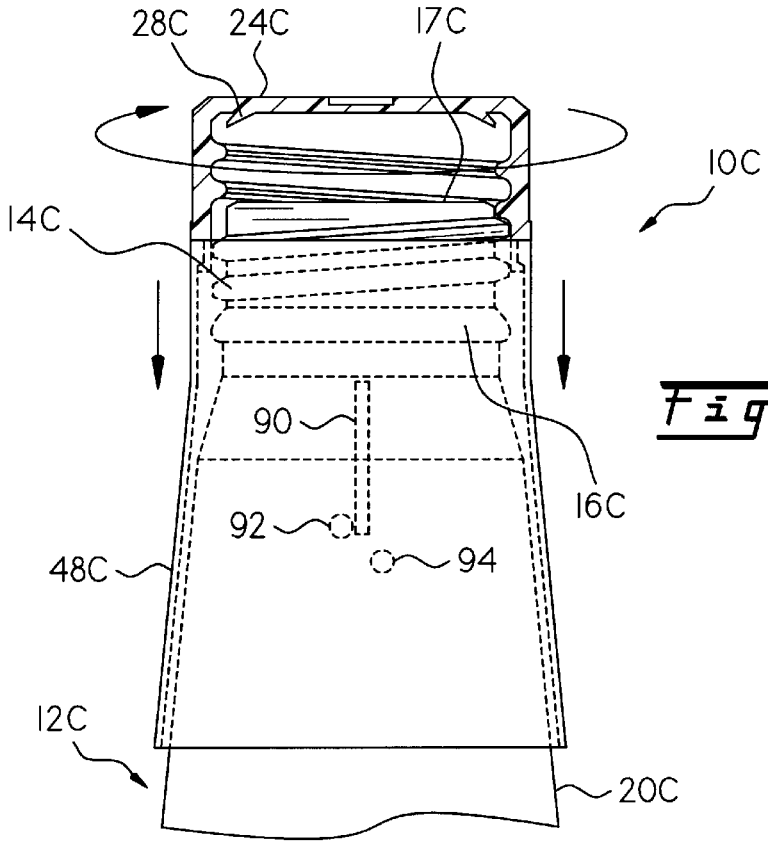
FIG. 29 is a partial cross-sectional side view of the cap and long band being placed on the bottle using the band alignment system.
Figure 30:
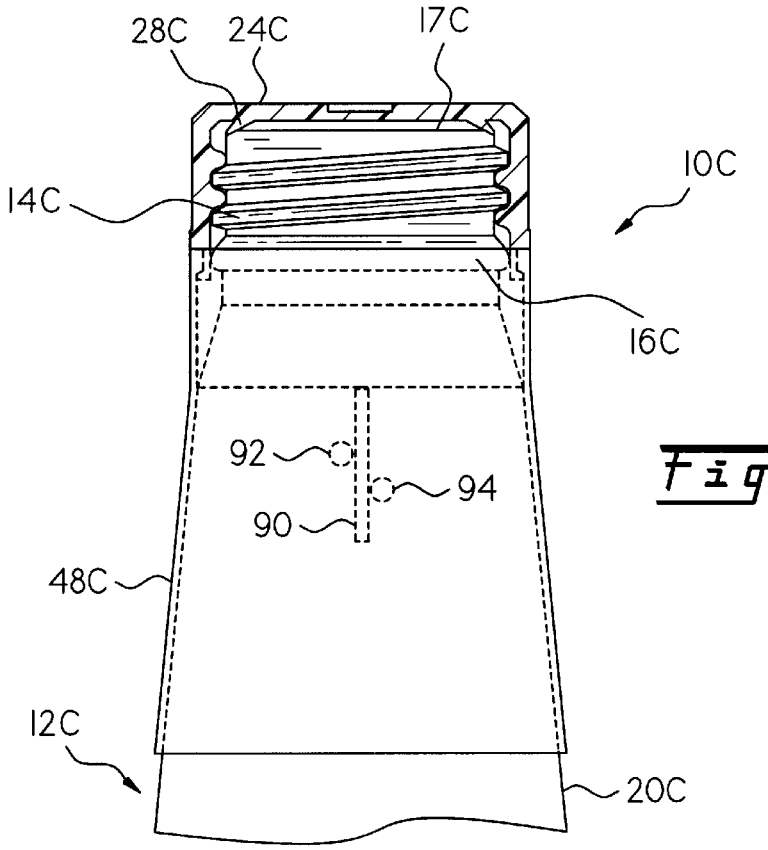
FIG. 30 is a partial cross-sectional side view of the cap and long band seated on the bottle using the band alignment system.

There is shown in FIGS. 28–30, inclusively, another modification of closure system in accordance with the present invention. The various components of the closures, such as the cap portion, tamper evident band and retaining ring are similar to those described above and accordingly, have been assigned the same numerals with a subscript "C". In accordance with this embodiment, the elongated skirt ($\mathbf{48}_c$) is provided with an axially extending rib or key (90) on the inner surface thereof and the neck of the container ($\mathbf{20}_c$) below the finish ($\mathbf{16}_c$) has a pair of circumferentially off-set protrusions or buttons ($\mathbf{92}_c$ and $\mathbf{94}_c$). By this arrangement, when the closure assembly is applied to the container and rotated in the present instance in a clockwise direction to apply it to the container, a lead portion of the key (90) engages the upper button (92). Since the skirt is prevented from further rotation because it is connected to the tamper evident band which can rotate relative to the cap portion, the keyway engages between buttons in the manner shown in FIG. 30 when the cap portion is fully seated. In this manner, advertising or indicia on the exterior of the sleeve can be precisely aligned with advertising or other indicia on the bottle.

Even though particular embodiments of the present invention have been illustrated and described herein, it is not intended to limit the invention and changes and modifications may be made therein within the scope of the following claims.

What is claimed is:

1. A closure assembly for a container having a retainer bead, comprising:

a cap portion having internal threads for cooperatively engaging the threads of a container's neck finish to apply, retain and remove the cap portion;

a retainer ring depending from the lower edge of the skirt portion of the cap and connected thereto by frangible connections; and a tamper evident band having means for mechanically engaging over said retaining ring and rotatable thereto having a portion completely overlying said frangible connections and including a series of flexible means for engaging under the retainer bead on the container's neck finish when the closure is fully seated.

2. A closure assembly as claimed in claim 1 wherein frangible connections are protected from inadvertent and intentional damage and stresses by a band portion which overlies the frangible connection.

3. A closure assembly as claimed in claim 1 including means for rotatably supporting the tamper evident band comprising a radially inwardly directed circumferentially extending rib which seats in a circumferentially extending pocket in the outer peripheral surface of the retainer ring.

4. A closure assembly as claim 3 wherein the inter-engaging rib on the tamper evident band and the pocket on the retainer ring are provided with tapered surfaces to position and secure the tamper evident band snugly but rotatable relative to the cap portion.

5. A closure assembly as claimed in claim 3 wherein said inter-engaging rib and pocket are provided with cam means whereby rotation of the cap portion relative to the container in one direction to remove said cap portion, produces axial displacement of said retainer ring and tamper evident band relative to one another to thereby fracture the bridge connections.

6. A closure assembly as claimed in claim 1 wherein the inter-engagement between the retaining ring and tamper evident band are made more secure as cap application forces cause the skirt portion of the cap to deform outwardly when the internal threads for cooperatively engaging the threads of a container's neck finish interact.

7. A closure assembly as claimed in claim 1 wherein said frangible connections comprises a series of circumferentially spaced frangible bridges.

8. A closure assembly as claimed in claim 1 wherein the flexible means engaging under the retainer bead comprise a plurality of inwardly biased spring fingers circumferentially spaced projecting from the outer terminal edge of the tamper evident band.

9. A closure assembly as claimed in claim 1, including a series of tapered ramps on the bottle neck finish below the retainer bead confronting spring fingers on the tamper evident band oriented in a manner to permit rotation of the tamper evident band in a direction to seat the cap portion on the container and which engage a shoulder of the ramps when the cap portion is rotated in a direction to remove it thereby preventing rotation of the tamper evident band relative to the container and causing breaking of the fracturable bridges.

10. A closure assembly as claimed in claim 1, wherein the tamper evident band includes an elongated skirt of a shape to generally conform to the shape of the container below the bottle neck finish.

11. A closure as claimed in claim 1, wherein the tamper evident band includes an elongated skirt that is provided with an elongated axially extending key and the container has a pair of spaced projections to receive the key to align the tamper evident band in a predetermined relationship to the container.

12. A closure assembly as claimed in claim 1, including an inter-engaging rib on the tamper evident band and a pocket on the retainer ring and wherein said retainer ring and tamper evident band are provided with cam means whereby rotation of the cap portion relative to the container in one direction to remove the cap portion, produces axial displacement of the retainer ring and tamper evident band relative to one another to thereby fracture the frangible connector uniformly about the circumference of the connecting area.

13. A closure assembly as claimed in claim 1, including a sleeve extending from the skirt portion provided with an elongated axially extending key and wherein the container has a pair of spaced projections to receive the key to align the sleeve in a predetermined relationship to the container.

14. A closure assembly as claimed in claim 1, wherein the tamper evident band includes an elongated skirt of a shape to conform to the shape of the container below the bottle finish having a key on the inner surface thereof which engages one of a pair of buttons on the neck of the bottle to position the closure assembly in a predetermined relationship to the bottle to indicia on the bottle when the closure assembly is fully seated.

15. A closure assembly for a container having external threads and a retainer bead said closure assembly comprising an outer cap, means for mounting and retaining said outer cap to an inner cap member having a skirt portion and internal threads for cooperatively engaging the threads of the container to apply, retain and remove the inner cap member;

a retainer ring depending from a lower edge of the skirt portion of the inner cap member and connected thereto by a series of circumferentially spaced frangible bridge connections;

a tamper evident band portion having a means for mechanically engaging over said retainer ring and rotatable thereto and including a series of flexible elements for engaging under the retainer bead on the container when the closure assembly is fully seated; and an outwardly projecting flange positioned to be engaged by said outer cap to fracture said bridge connections as the outer cap is depressed to engage a series of inter-engaging lugs and ribs, whereby the inner cap and outer cap rotate together for removal from the container.

16. A closure assembly for a container having external threads and a retainer bead said closure assembly comprising an outer cap, means for mounting said outer cap to an inner cap having internal threads for cooperatively engaging the container threads to apply and remove the inner and outer caps; a retainer ring depending from the lower edge of the skirt portion of the inner cap and connected thereto by a series of circumferentially spaced bridge connections; and a tamper evident band having means for mechanically engaging and mounting to said retaining ring and rotatable thereto and including a series of flexible elements for engaging under the retainer bead on the container when the closure assembly is fully seated, and wherein the tamper evident band has a radially outwardly projecting flange positioned to be engaged by the outer cap to fracture the bridge connections as the outer cap is depressed to engage a series of inter-engaging lugs and ribs on the inner cap and the outer cap, whereby the inner cap and outer cap rotate together for removal from the container.

17. A tamper evident closure for containers having a finish with threads and a radially outwardly directed circumferentially extending bead below the threads said closure comprising:

a cap portion having internal threads for cooperatively engaging the threads on a container to apply and remove the cap portion;

a retainer ring depending from the lower edge of the skirt portion of the cap and connected thereto by a series of circumferentially spaced bridge connections; and a tamper evident band having means for rotatably mounting on the retaining ring and including a series of spring fingers for engaging under the retainer bead on the container when the closure is fully seated, said tamper evident band having a radially outwardly projecting flange positioned to be engaged by an outer cap to fracture the bridge connections.

18. A closure assembly as claimed in claim 17, a series of tapered ramps on the bottle finish below the retainer bead and wherein said spring fingers are oriented in a manner to permit rotation of the tamper evident band in a direction to seat the inner cap on the container, said spring fingers engaging and which engage a shoulder of the ramps when the inner cap portion is rotated in a direction to remove it thereby preventing rotation of the tamper evident band relative to the container and causing breaking of the fracturable bridges.

19. A closure assembly comprising an outer cap, an inner cap, a spring means for normally biasing the outer cap to a raised position relative to the inner cap and including a series of inter-engaging lugs and ribs on the inner and outer caps, whereby when the outer cap is pressed axially downwardly to overcome the bias of said spring means, the lugs and ribs inter-engage whereby the caps rotate together to remove the closure assembly from a container, and a tamper evident band connected to the inner cap having a radially outwardly projecting flange positioned to be engaged by the outer cap to fracture bridge connections connecting a breakaway ring to said inner cap.

20. A closure assembly as claimed in claim 19 including a series of circumferentially spaced frangible bridges connecting said tamper evident band to said inner cap.

21. A closure assembly as claimed in claim 19 including flexible means for engaging under the retainer bead comprising a plurality of inwardly biased spring fingers circumferentially spaced and projecting from the inner terminal edge of the tamper evident band.

22. A closure assembly as claimed in claim 19 including a series of tapered ramps on the bottle neck finish below the retainer bead and confronting the spring fingers of the tamper evident band portion oriented in a manner to permit rotation of the tamper evident band in a direction to seat the cap portion on a container and which engage a shoulder of the ramps when the cap portion is rotated in a direction to remove it thereby preventing rotation of the tamper evident band relative to the container and causing breaking of the fracturable bridges.

23. A tamper evident closure for a container having a finish with threads and a radially outwardly, circumferentially extending bead below the threads said closure comprising:

a cap having a skirt portion and internal threads for cooperatively engaging the threads on the container to apply and remove the cap portion;

a retainer ring depending from the lower edge of the skirt portion of the cap and connected thereto by a series of circumferentially spaced bridge connections;

a tamper evident band having means for rotatably mounting the tamper evident band onto the retaining ring and means engaging under for the retainer bead on the container when the closure is fully seated; and said tamper evident band having a radially outwardly projecting flange positioned to be engaged by the cap to fracture the bridge connections.

24. A closure assembly as claimed in claim 23 wherein said means for rotatably mounting the tamper evident band comprises a radially inwardly directed circumferentially extending rib which seats in a circumferentially extending pocket in the outer peripheral surface of the retainer ring.

25. A closure assembly as claimed in claim 24, wherein the inter-engaging rib and pocket on the retainer ring and tamper evident band respectively, are provided with tapered surfaces to position and secure the tamper evident band portion snugly but rotatable relative to the cap.

26. A closure assembly as claimed in claim 24 wherein the inter-engaging rib and pocket on the retaining ring and tamper evident band, respectively, are provided with cam means whereby rotation of the cap relative to the container in one direction to remove the cap, produces axial displacement of said retaining ring and tamper evident band relative to one another to thereby fracture the bridge connections.

27. A closure assembly as claimed in claim 23 wherein the inter-engagement between the retaining ring and tamper evident band is made more secure as cap application forces cause the skirt portion of the cap to deform outwardly when the internal threads cooperatively engage the threads of the container's neck finish.

* * * * *